United States Patent [19]

Finsterwalder et al.

[11] 3,948,075

[45] Apr. 6, 1976

[54] APPARATUS FOR LIMITING THE WORKING STROKE OF A PRESS RAM

[75] Inventors: Kurt Finsterwalder, Goppingen-Bartenbach; Karl-Heinz Philipp, Goppingen, both of Germany

[73] Assignee: L. Schuler GmbH, Germany

[22] Filed: Jan. 24, 1975

[21] Appl. No.: 543,914

[30] Foreign Application Priority Data

Jan. 25, 1974 Germany ..... 2403532

[52] U.S. Cl. ..... 72/351; 72/417

[51] Int. Cl.² ..... B21D 24/14

[58] Field of Search ..... 72/417, 350, 351; 267/119

[56] References Cited

UNITED STATES PATENTS

| | | | |
|---|---|---|---|
| 2,672,836 | 3/1954 | Ernst | 72/417 |
| 2,872,886 | 2/1959 | Longfield | 72/417 |
| 3,180,634 | 4/1965 | Heiser | 267/119 |
| 3,279,780 | 10/1966 | Williamson | 267/119 |
| 3,375,001 | 3/1968 | Hennells | 267/119 |
| 3,490,757 | 1/1970 | Haanes | 267/119 |

*Primary Examiner*—Lowell A. Larson
*Attorney, Agent, or Firm*—Craig & Antonelli

[57] ABSTRACT

Press apparatus including a blank holding ram and a drawing ram which are reciprocally driven such that the holding ram can hold a blank of material while the drawing ram moves relatively to the holding ram to perform a drawing operation on the blank. Stops are provided for limiting the movement of the holding ram with pressure fluid cushions being arranged in the drive train for the holding ram so as to accommodate a dwell phase with the holding rams against the stops during the drawing operation.

10 Claims, 3 Drawing Figures

APPARATUS FOR LIMITING THE WORKING STROKE OF A PRESS RAM

BACKGROUND AND SUMMARY OF THE INVENTION

This invention relates to an apparatus for limiting the working stroke of a cutting or blank holding ram in mechanically operated presses with particularly combined cutting and drawing tools, as well as with elastic pads disposed in the respective ram pressure points (centers).

It is necessary in such presses, after a cutting step has been executed, for the respective blank holder, which can be the cutting ram proper or, which can be connected to such cutting ram, to have an exactly defined dwell (rest) phase in the press cycle, during which the drawing operation following the cutting step is accomplished. While this dwell phase can be provided with sufficient accuracy in so-called universal presses by an appropriate selection of the universal joint system, this is not the case in eccentric presses, as is well known.

Therefore, it is an object of this invention to find ways and means to obtain even and especially in case of the lastmentioned press types, a dwell phase of the stamping or blank holding ram.

To attain this object, the present invention suggests to arrange, in the tool zone, stops for the cutting or blank holding ram and to associate the respective ram pressure points with at least one storage zone for receiving the elastic pads which have been displaced and/or temporarily deformed after the ram has met with the stops.

These stops are adjustable with respect to their level and are arranged symmetrically with respect to the associated ram. The required storage space can be provided within the ram proper or outside of the ram according to different contemplated preferred embodiments of the present invention.

The mode of operation of the apparatus according to this invention is such that the cutting or blank holding ram, after meeting with the stops, is arrested already prior to reaching its lower dead center position effected by the drive means, while the drive piston (connecting) rods of the ram continue their operation and dip into the elastic pads. During this immersing time, wherein thus the stamping or blank holding ram is perforce in the rest position due to its meeting with the stops, the so-called overshoot stroke (overtravel) of the ram is absorbed in the ram pressure point, and the thus-displaced or temporarily deformed elastic pad is displaced into the associated storage spaces.

In this connection, it is contemplated by the present invention to employ as the elastic pad several types of mechanical elements, such as springs or the like. In particularly preferred embodiments it is contemplated to arrange deformable masses and/or pressure fluid cushions in the ram pressure point.

In addition to providing an accurately defined immersion (plunging) time, i.e. dwell phase, another advantage of the arrangement according to this invention resides in that the level adjustability of the stops affords the possibility of smaller ram adjustments without having to utilize complicated adjustment mechanisms for this purpose.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE DRAWINGS

Figure 1:
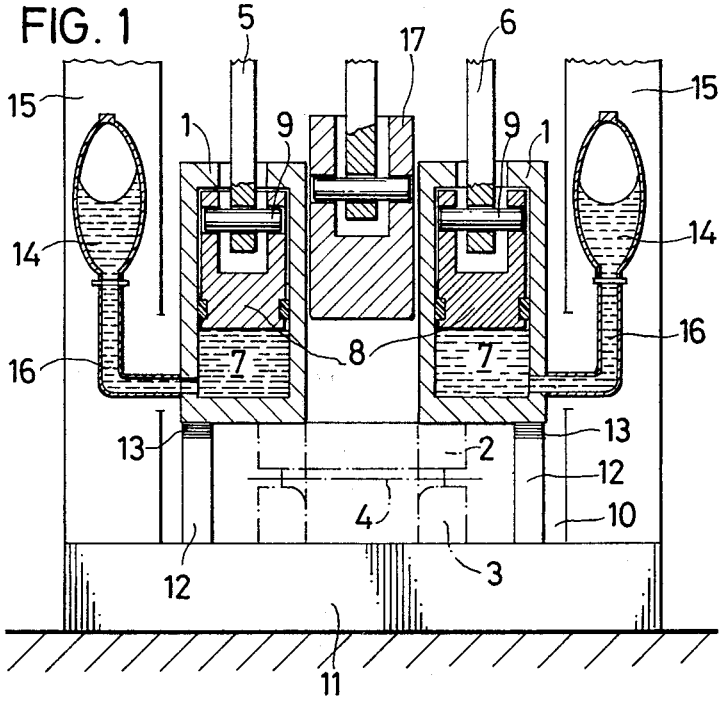
FIG. 1 is a schematic side view of portions of a press including the ram and the associated elements constructed according to this invention.

In the embodiment illustrated in FIG. 1, a cutting ram 1, which is simultaneously the blank holder for blank 4 by way of the schematically illustrated tools 2, 3, is connected via two drive connecting rods 5, 6 to a drive unit (not illustrated since drive units of conventional construction can be used with the present invention). Each pressure point of this ram 1 is connected with the drive connecting rods 5, 6 via a liquid pad 7, a piston 8, and a pin 9. In the tool zone 10, stops 12 are disposed on the press table 11, the level of these stops being variable by the addition or withdrawal of spacer elements or disks 13.

In operation, when the ram 1 meets with the stops 12 before reaching the lower dead center position "UT" of the ram (lower dead center position of piston 8), the pistons 8 with the piston rods 5, 6 dip into the space 7 due to the resistance imposed by stops 12. The thus-displaced pressure fluid escapes into storage bubbles (bulbs) 14. In the illustrated embodiment, these bubbles are located in the pedestal columns 15 and are in communication with the pads 7 via conduits 16. When the force on pistons 8 is relieved by upward movement of rods 5 and 6, the fluid in space 7 forces return of pistons 8 to the position shown.

Figure 2:
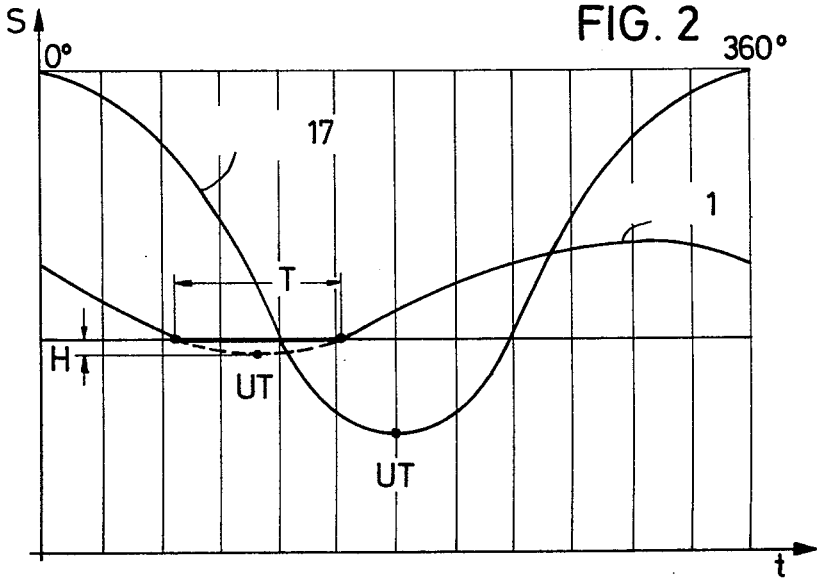
FIG. 2 shows a stroke-time (trajectory) diagram in a comparison of forming ram and drawing ram.

As shown in FIG. 2 by means of a stroke-time diagram, the drawing ram 17, arranged within the ram 1, is set into operation during the plunger period "T" of the ram 1. The symbol "H" in this diagram denotes the distance by which the connecting rods 5, 6 plunge into the pressure pads 7. The course of the curve of the ram 1 during the plunging time "T" is linear and constant because of the stops 12.

Reference is hereby made to U.S. Pat. Nos. 2,345,353 and 2,900,943 for background information concerning drawing presses of the type of which the present invention is directed to improve.

Figure 1A:
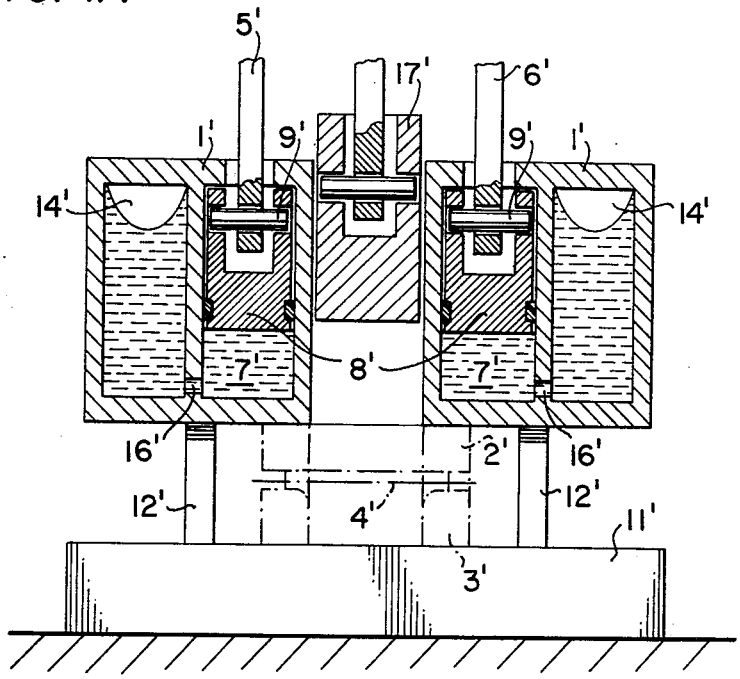
FIG. 1A is a schematic side view corresponding to FIG. 1 and showing another preferred embodiment of the invention.

FIG. 1A illustrates a second preferred embodiment of the invention, wherein primed reference numerals are included for designating like structure of the FIG. 1 embodiment. The embodiment of FIG. 1A differs from the embodiment of FIG. 1 only in that the storage bubbles or bulbs 14' are provided in the ram 1', rather than being separate therefrom.

While we have shown and described only two embodiment in accordance with the present invention, it is understood that the same is not limited thereto but is susceptible of numerous changes and modifications as known to those skilled in the art, and we therefore do not wish to be limited to the details shown and described herein, but intend to cover all such changes and modifications as are encompassed by the scope of the appended claims.

We claim:

1. Press apparatus comprising:
a blank holding ram,
a drawing ram,
mechanical non-hydraulic driving means for reciprocally driving said holding ram and drawing ram such that said holding ram can hold a blank of material while said drawing ram moves relatively to said blank holding ram to perform a drawing operation on said blank,
and stop means for limiting the movement of said holding ram,
said driving means for said holding ram including a first driving part movable over a predetermined path and elastic pad means interposed between said first part and said holding ram, said elastic pad means including means temporarily elastically deformable by said first part during the portion of the travel path of said first part when said holding ram is engaged with said stop means.

2. Apparatus according to claim 1, wherein said elastic pad means includes a liquid filled space intermediate the first part and holding ram as well as a liquid storage space communicated with said first mentioned space for accommodating liquid when said first part dips into said first mentioned space during stoppage of said holding ram by said stop means.

3. Apparatus according to claim 2, wherein said liquid filled space is bounded by cylinder walls which slidably guide said first part and by a side of said holding ram facing away from the blank, said liquid serving to transfer forces and movement from said first part to said holding ram until said holding ram engages said stop means, at which point the forces against the holding ram are maintained while said first part dips into said liquid filled space.

4. Apparatus according to claim 3, wherein said holding and drawing rams are part of an eccentric press having eccentric drive means for continuously cyclingly driving said holding and drawing rams in parallel to one another.

5. Apparatus according to claim 3, wherein said holding ram serves simultaneously as a cutting ram which cooperates with cutting tools to cut said blank during movement of said holding ram.

6. Apparatus according to claim 3, wherein said stop means are positioned symmetrically with respect to said holding ram, and wherein said stop means are adjustable in length for varying the stroke of the holding ram without change to the drive train thereof.

7. Apparatus according to claim 6, wherein the elastic pad means are fashioned as pressure fluid cushions having associated storage spaces fashioned as storage bubbles so that a closed continuously reversible fluid cushion is obtained.

8. Apparatus according to claim 3, wherein said storage space for said liquid is disposed within the confines of the holding ram.

9. Apparatus according to claim 3, wherein said storage space for said liquid is disposed outside the confines of the holding ram.

10. Apparatus according to claim 1, wherein the elastic pad means are fashioned as pressure fluid cushions having associated storage spaces fashioned as storage bubbles so that a closed continuously reversible fluid cushion is obtained.

* * * * *